US005998915A

United States Patent [19]

Scholz et al.

[11] Patent Number: 5,998,915

[45] Date of Patent: Dec. 7, 1999

[54] MOUNTING SUPPORT FOR A HIGH INTENSITY DISCHARGE REFLECTOR LAMP

[75] Inventors: John A. Scholz, Georgetown; Edward H. Nortrup, Stoneham, both of Mass.; Kevin Provagna, Medina; James Gensert, Litchfield, both of Ohio

[73] Assignee: Osram Sylvania Inc., Danvers, Mass.

[21] Appl. No.: 09/041,295

[22] Filed: Mar. 12, 1998

Related U.S. Application Data

[60] Provisional application No. 60/046,060, May 9, 1997.

[51] Int. Cl.[6] ..... H01J 5/50

[52] U.S. Cl. ..... 313/234; 362/263; 362/217; 362/221; 362/226; 313/634; 313/317; 313/25

[58] Field of Search ..... 362/217, 226, 362/221, 263; 313/234, 243–263, 493, 491, 631, 634, 238–285, 573, 623, 110–112, 317, 318.01, 318.02, 25, 113

*Primary Examiner*—Sandra O'Shea
*Assistant Examiner*—Ismael Negron
*Attorney, Agent, or Firm*—William H. McNeill

[57] ABSTRACT

A mounting assembly for a reflector lamp. The mounting assembly comprises a 0.050" diameter stainless steel rod that has been formed into a three-turn spiral. The spiral surrounds the inner jacket mount assembly of the reflector lamp, and fits into the neck region of the reflector. The lower leg of the spiral either takes the place of, or augments a "dummy" lead presently used in the inner jacket press, so that one or both fit into the reflector eyelet opening in the neck of the reflector. The opposite end of the spiral piece extends upwardly, and is connected to the upper lead of the Model No. PAR30L inner jacket mount assembly of the Model No. MPD70 lamp.

11 Claims, 2 Drawing Sheets

MOUNTING SUPPORT FOR A HIGH INTENSITY DISCHARGE REFLECTOR LAMP

This application claims the benefit of U.S. Provisional Application No. 60/046060, filed May 9, 1997.

FIELD OF THE INVENTION

This invention relates to fabrication processes for High Intensity Discharge (HID) lamps and, more particularly, to an improved mounting support for a low wattage arc tube having an aluminosilicate outer jacket.

BACKGROUND OF THE INVENTION

High Intensity Discharge (HID) lamps have been manufactured in a variety of envelope (jacket) shapes and sizes. These lamps generally comprise jackets suited to particular applications. Some metal halide lamps are referred to as being double ended. This relates to the fact that the arc tube is held within a tubular-like outer jacket or sleeve, and each end of the outer jacket has a base member. The arc tube that is the subject of this invention is double ended and is enclosed within a sealed jacket and has one lead connected to each end of the jacket, thereby being securely held in place within the jacket. The jacket, in turn, is held in place by fixture connections. These connections supply the electrical energy required for the discharge capsule (arc tube), and also provide means of physical support for the lamp.

The more common type of HID lamp has been the single end type of lamp, such as Model Nos. ED17, BT37, etc., manufactured by the present assignee, Osram-Sylvania. The lamp consists of a quartz tube (and other ancillary components) within a glass envelope. The envelope has a base attached to one end. The base is the means of transferring electric power to the arc capsule and is also the means of physical support for the whole lamp. The arc discharge capsule is rigidly supported, within the glass envelope, to a flare stem at the base region.

It has been common practice to add hardware to support the arc tube mount assembly. These added parts make use of the opposite (base) end of the glass envelope to secure the mount assembly rigidly, so that it will withstand the rigors of handling and shipping. Methods of securing the other end within the glass envelope range from spring-like members that exert a force against the glass envelope interior to other types of glass envelopes that have "dimples" or protuberances molded into them at the opposite (base) end. Portions of the mount assembly can be secured to these molded pieces by fitting them either into, or around, the protrusions. This secures the components and assures the structural integrity of the lamp.

More recently, metal halide lamps have utilized a "shroud" or other means that surround the arc discharge capsule. This shroud is, consequently, a part of the mount structure. It is believed that this enclosure may contribute to the thermal stability of the arc tube operation. The shroud may also be utilized as a means of providing an infrared reflecting surface in order to improve the efficacy of the lamp. It also may be used to reduce the amount of transmitted ultraviolet radiation, or may be used to improve the containment characteristics of a lamp, particularly during arc tube rupture.

Unfortunately this shroud enclosure contributes weight to the mount assembly. The added weight, in turn, increases the possibility of dislocating or shifting the position of the assembly during handling and shipping.

A recent metal halide arc discharge lamp design manufactured by the present assignee utilizes a formed arc tube disposed within a hermetically sealed aluminosilicate inner jacket. This assembly is housed within a bonded lens reflector jacket.

This configuration poses an interesting conundrum. On one hand, exacting demands are placed on the manufacturing processes needed to fabricate this product; and on the other hand, the design provides an opportunity for a new, unique high efficacy light source with good color temperature and excellent color rendering index. This design also has the advantage of being directed, owing to its being in a reflector outer jacket.

The process of fabricating this bonded lens metal halide lamp consists of a series of steps. Glassware is received without eyelets in the heel, or a lens on the reflector. It has not been aluminized and obviously does not contain a light source. The glassware is processed to accept and secure eyelets through the heel region. The interior surface of the glassware is then coated with a vapor-deposited layer of aluminum (reflective surface). The light source is then inserted into the now aluminized glassware, and bonded to the attached eyelets to ensure mechanical strength and electrical contact. The entire unit is further processed to bond the lens to the reflector. The very nature of this process precludes any method of allowing a capsule or arc tube mount assembly that is bonded to the eyelets, from being secured to the opposite (lens) end.

A similar mount assembly of considerable mass, secured at only one end, is illustrated in U.S. Pat. No. 5,043,623, issued to Scholz et al, and entitled REFLECTOR LAMP ASSEMBLY INCLUDING METAL HALIDE ARC TUBE. The patent teaches a design wherein an electrically-isolated support ring located in the heel region of the reflector is attached to the connecting rod of the mount structure. The mounting assembly of this invention cannot utilize those teachings, owing to the lack of electrically-isolated mounting components, such as a connecting rod, to secure the ring support in order to provide mount structural integrity without sacrificing lamp performance.

One of the inherent difficulties with such mounting assemblies is the physical size and mass of the inner jacket mount. The HID lamp of this invention is a factor of two larger in "glass length", and a factor of five higher in weight, than are similar halogen capsule mountings. These increases exert additional stress upon the single-ended mount within the reflector of the inventive assembly.

The use of butt welding improved the strength of the inner jacket press region, but was not sufficient to survive the rigors associated with lamp shipping and dropping. A rigid length of molybdenum wire (0.020" dia.) was recently utilized to connect from one eyelet to the top of the mount structure. However, owing to the overall length of the mount, the mount structure flexed considerably during shipping and handling. This flexing produced leverage and high levels of stress on the press region, which resulted in the cracking of the press.

Work-hardened nickel (0.035" dia.) was also tried, but flexing and mount movement still resulted in press cracking.

The present mounting assembly of this invention provides additional stability and rigidity for the mount of a reflector lamp. The invention improves the strength of the mount structure and additionally limits mount movement. This reduces the leveraged stress to the press region of the inner jacket.

This improvement also substantially reduces or eliminates the flexure-induced press cracking previously encountered.

A further advantage of using the spiral mount of the present invention is an unexpected enhancement of the lamp-starting characteristics.

DISCLOSURE OF THE INVENTION

It is, therefore, an object of the invention to obviate the disadvantages of the prior art.

It is another object of the invention to provide an improved lamp assembly featuring a new spiral mount.

It is another object of this invention to provide a new mount for a reflector lamp assembly that reduces flexure and breakage of the lamp assembly.

It is a further object of this invention to provide a new mount for a reflector lamp assembly that provides quicker starting of the lamp.

These objects are accomplished, in one aspect of the invention, by providing a new mounting assembly for a reflector lamp. The mounting assembly comprises a metal mounting rod that has been formed into a three-turn spiral. The spiral surrounds the inner jacket mount assembly of the reflector lamp, and fits into the neck region of the reflector. The lower leg of the spiral either takes the place of, or augments a "dummy" lead that is presently used in the inner jacket press, so that one or both fits into the reflector eyelet opening in the neck of the reflector. The opposite end of the spiral piece extends upwardly and is connected to the upper lead of an inner jacket mount assembly of a lamp.

The inner jacket fits loosely inside of the spiral mount support. The stainless metal mounting rod surrounds the inner jacket assembly, as it restricts movement of the mount assembly, thereby reducing the stress and forces upon the metal-to-glass junctions of the inner jacket press region.

A further advantage of using the spiral mount of the present invention is an unexpected enhancement of the lamp starting characteristics.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
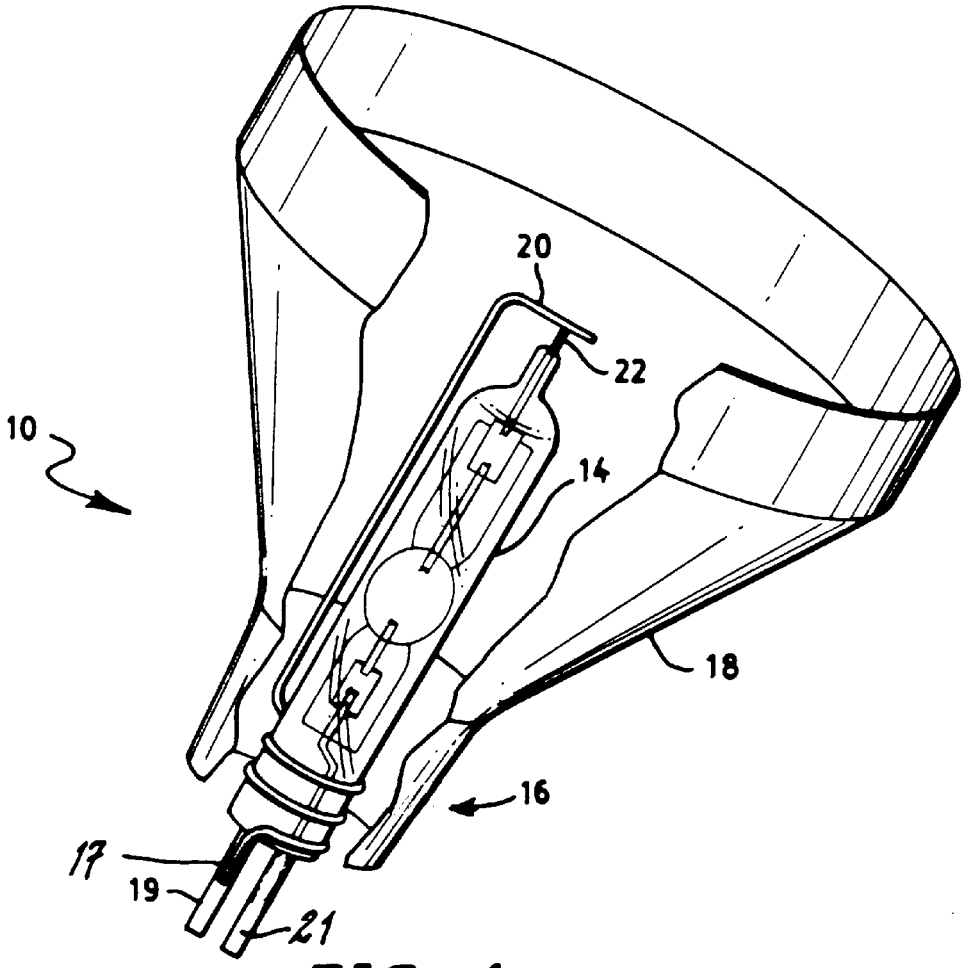
FIG. 1 illustrates a perspective, cut-away view of the reflector lamp being braced by the spiral mount assembly of this invention.
Figure 3:
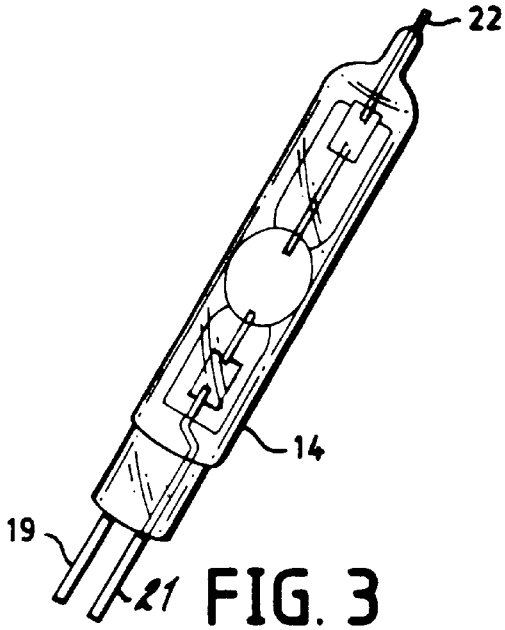
FIG. 3 shows the inner jacket mount assembly illustrated in FIG. 1.
Figure 2:
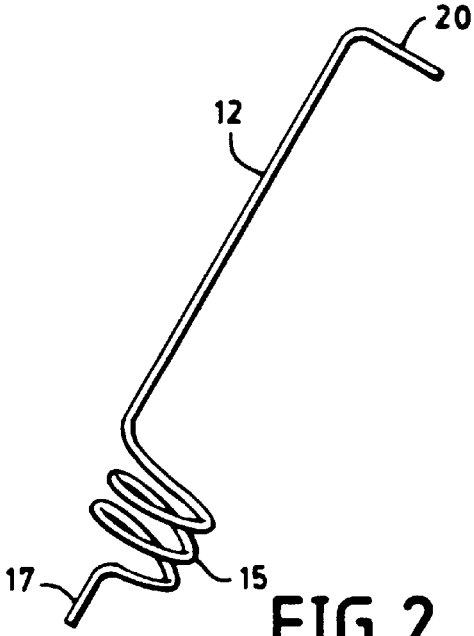
FIG. 2 depicts the spiral mount of this invention, as shown in FIG. 1.
Figure 4:
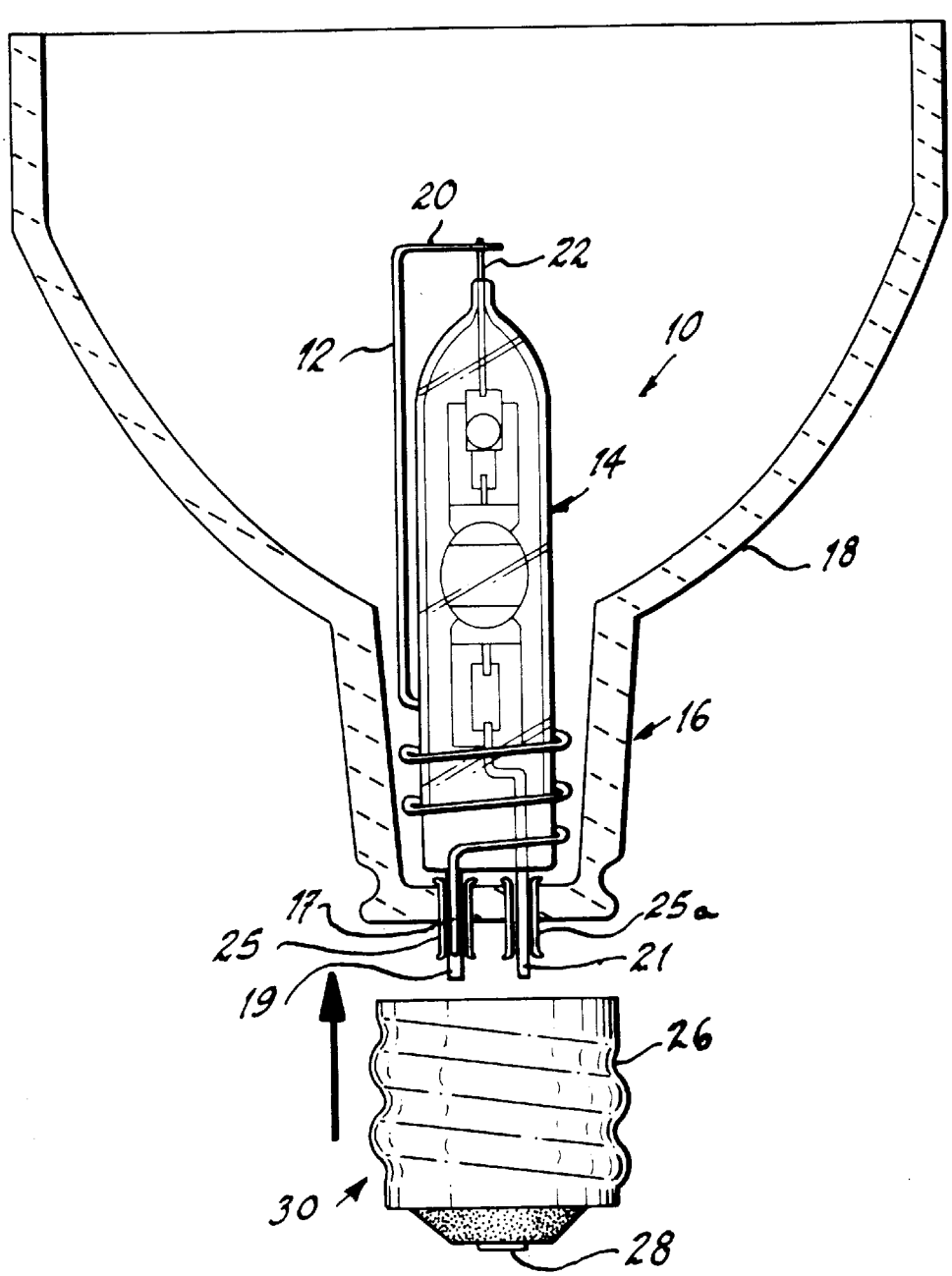
FIG. 4 is a sectional, elevational view of a lamp of the invention.

Referring to FIG. 1, a mounting assembly 10 is illustrated. The mounting assembly 10 comprises a metal mounting rod 12, which is preferably a 0.050" diameter stainless steel rod that has been formed into a three-turn spiral 15, as shown in greater detail in FIG. 2. The spiral 15 surrounds the inner jacket mount assembly 14 (shown in FIG. 3), and fits into the neck region 16 of the reflector 18. The lower leg 17 of the spiral 15 either takes the place of, or augments a "dummy" lead 19 that is presently used in the inner jacket press, so that one or both fits into the reflector eyelet opening 25 in the neck 16 of the reflector 18. The opposite end 20 of the spiral 15 extends upwardly, and is connected to the upper lead 22 of the inner jacket mount assembly 14. Bottom lead 21 extends from the base of inner jacket mount assembly 14, adjacent dummy lead 19, and fits through a second eyelet 25*a*. The leads are welded or crimped to the eyelets 25 and 25*a* and subsequently are attached to the shell 26 and center conductor 28, respectively, of base 30.

The inner jacket 14 fits loosely inside of the spiral 15. The stainless steel wire surrounds the inner jacket mount assembly 14, as it restricts movement of the mount assembly, thereby reducing the stress and forces upon the metal-to-glass junctions of the inner jacket press region.

EXAMPLE 1

One lamp unit was operated inside a reflector (without a lens) in order to observe any expansion that may occur as the wire heats. No expansion problems were evident.

An additional benefit associated with the use of the spiral 15 is its axial alignment with the inner jacket mount assembly 14 within the reflector 18. Poor axial alignment of the inner jacket mount assembly 14 previously has been shown to accentuate a perceptual color separation phenomenon.

A further advantage of using the spiral 15 of the present invention is an unexpected enhancement of the lamp starting characteristics, as will be seen below.

EXAMPLE 2

Four lamps were operated without the spiral 15, and averaged almost five minutes (three attempts each) to start. A similar group of lamps containing the spiral 15 was observed to start in an average of two seconds. The spiral mount may be acting as a "ground plane", thereby facilitating the lamp starting.

It should be understood that although the invention disclosed herein has been used with a particular lamp environment, this is meant to be only exemplary of the scope and purpose of this invention. This teaching is not limited to a metal halide lamp or to reflector outer jackets. The invention can also be used in applications using tungsten halogen units.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

While there have been shown and described what are at present considered the preferred embodiments of the invention, it will be apparent to those skilled in the art that various changes and modifications can be made herein without departing from the scope of the invention as defined by the appended claims.

What is claimed is:

1. A mounting assembly for a reflector lamp, comprising: a reflector, an inner jacket mount assembly, and a mounting rod that has been formed into a spiral portion, said spiral portion surrounding said inner jacket mount assembly of said reflector lamp, said spiral portion of said mounting rod fitting into a neck region of said reflector of said reflector lamp, a lower leg of said rod taking a place of a dummy lead in an inner jacket press of said inner jacket mount assembly, so that it fits into a reflector eyelet opening in said neck region of the reflector, an opposite end of said spiral portion of said mounting rod extending upwardly, and being connected to an upper lead of said inner jacket mount assembly.

2. The mounting assembly for a reflector lamp in accordance with claim 1, wherein said mounting rod is approximately 0.050 inches in diameter.

3. The mounting assembly for a reflector lamp in accordance with claim 1, wherein said mounting rod comprises stainless steel.

4. The mounting assembly for a reflector lamp in accordance with claim 1, wherein said spiral portion comprises three turns.

5. A mounting assembly for a reflector lamp, comprising: a reflector, an inner jacket mount assembly, and a mounting rod that has been formed into a spiral portion, said spiral portion surrounding said inner jacket mount assembly of said reflector lamp, said spiral portion of said mounting rod fitting into a neck region of said reflector of said reflector lamp, a lower leg of said rod augmenting a dummy lead in an inner jacket press of said inner jacket mount assembly, so that both of said lead and said lower leg fit into a reflector eyelet opening in said neck region of the reflector, an opposite end of said spiral portion extending upwardly, and being connected to an upper lead of said inner jacket mount assembly.

6. The mounting assembly for a reflector lamp in accordance with claim 5, wherein said mounting rod is approximately 0.050 inches in diameter.

7. The mounting assembly for a reflector lamp in accordance with claim 5, wherein said mounting rod comprises stainless steel.

8. The mounting assembly for a reflector lamp in accordance with claim 5, wherein said spiral portion comprises three turns.

9. A method of fabricating a reflector lamp, comprising the steps of:

a) fabricating a reflector;

b) forming eyelets in a neck portion of said reflector;

c) inserting a light source into the reflector;

d) placing a supporting rod about said light source, said supporting rod having a spiral portion;

e) fitting said supporting rod into a neck region of said reflector, a lower end of said supporting rod augmenting a dummy lead of said light source, so that both of said dummy lead and said lower end fit into one of said eyelets; and f) connecting an opposite end of said spiral portion extending upwardly, to an upper lead of said light source.

10. A method of fabricating a reflector lamp, comprising the steps of:

a) fabricating a reflector;

b) forming eyelets in a neck portion of said reflector;

c) inserting a light source into the reflector;

d) placing a supporting rod about said light source, said supporting rod having a spiral portion;

e) fitting said supporting rod into a neck region of said reflector, a lower leg of said supporting rod taking the place of a dummy lead of said light source, so that said lower leg fits into one of said eyelets; and f) connecting an opposite end of said spiral portion extending upwardly, and being connected to an upper lead of said light source.

11. A reflector lamp comprising: a reflector, an inner jacket mount assembly, and a mounting rod that has been formed into a spiral portion, said spiral portion surrounding said inner jacket mount assembly of said reflector lamp, said spiral portion of said mounting rod fitting into a neck region of said reflector of said reflector lamp, a lower leg of said rod taking a place of a dummy lead in an inner jacket press of said inner jacket mount assembly, so that it fits into a reflector eyelet opening in said neck region of the reflector, an opposite end of said spiral portion of said mounting rod extending upwardly, and being connected to an upper lead of said inner jacket mount assembly.

* * * * *